US005172433A

United States Patent [19]

Lake

[11] Patent Number: 5,172,433

[45] Date of Patent: Dec. 22, 1992

[54] SPA WITH CONVERTIBLE FURNITURE LAYOUT

[76] Inventor: John S. Lake, 34 Atherton, Irvine, Calif. 92720

[21] Appl. No.: 759,531

[22] Filed: Sep. 13, 1991

[51] Int. Cl.[5] ..... A47K 3/022; A61H 33/02

[52] U.S. Cl. ..... 4/541.4; 4/579; 4/541.6

[58] Field of Search ..... 4/488, 489, 492, 494, 4/496, 524, 528, 531, 532, 533, 541, 542, 543, 544, 546, 547, 559, 571.1, 578, 579, 611; 297/232, 180, 463

[56] References Cited

U.S. PATENT DOCUMENTS

| | | | |
|---|---|---|---|
| 3,559,634 | 2/1971 | Lillywhite | 4/579 X |
| 3,813,702 | 6/1974 | Diemond et al. | 4/494 |
| 4,192,024 | 3/1980 | Zigmont | 4/496 |
| 4,237,561 | 12/1980 | Britton | 4/546 |
| 4,340,982 | 7/1982 | Hart et al. | 4/542 X |
| 4,466,141 | 8/1984 | Starkey | 4/542 X |
| 4,746,161 | 5/1988 | Futrell | 297/232 X |
| 4,776,046 | 10/1988 | Newberry et al. | 4/541 |
| 4,839,930 | 6/1989 | Watkins | 4/546 |

FOREIGN PATENT DOCUMENTS

| | | | |
|---|---|---|---|
| 3447161 | 7/1986 | Fed. Rep. of Germany | 4/492 |
| 3714242 | 5/1988 | Fed. Rep. of Germany | 4/579 |

*Primary Examiner*—William A. Cuchlinski, Jr.
*Assistant Examiner*—W. Morris Worth
*Attorney, Agent, or Firm*—Frank C. Price

[57] ABSTRACT

A household-type spa is presented which is based upon one single, major mold for manufacturing the water-containing vessel. The spa has attachment points over its walls and floor for mounting furniture such as benches and bucket seats. All furniture, regardless of type, has mounting points which correspond to those in the spa walls. Also, water and water/air jets can be directed from the spa walls outward to the person in a given seat which is spaced some distance from the spa wall, itself. The result is a spa concept which allows customers to chose a large variety of seating arrangement and jet-effect arrangements, all for a single vessel wall design.

5 Claims, 6 Drawing Sheets

SPA WITH CONVERTIBLE FURNITURE LAYOUT

FIELD OF THE INVENTION

This invention applies to spas which are tubs for containing swirling warmed water, water jets, air/water jets and people in various positions of repose for enjoyment. The units may be above or below ground level, indoors or outdoors, connected with a swimming pool system or independent with a complete system of pumps and heaters. Most suppliers offer a variety of models, each with a different seating arrangement.

BACKGROUND

Currently, the spas which are offered by manufactures are made with the inner surface of the spa shaped in complicated form at various positions within the spa to create seating for the occupants. Thermal plastic sheeting is used in most cases. It is applied by vacuum forming of the spa internal surfaces against a female mold made of wood and gel-coated fiber glass. The inner surface has also been made in much the same shapes, including seating, by rotational molding. Each spa configuration, forming the pool and the seating shelves which are part of the wall, requires its own particular mold. Manufacturers normally use several molds in order to be able to offer a variety of seating arrangements.

An important feature of spas is the positioning of ports in the wall where jets of water or water/air mix can be located to impinge upon the occupants of the spa. Customarily, once the spa is finished in production, the arrangements of jets is fixed.

Spas can be shaped internally in many different ways. This determines how many people may be seated, how each person may be seated and how impinging jets of air/water aimed. However, manufacturers must limit their variety of models because each one requires its own mold. The molds are large and they are very costly.

SUMMARY OF THE INVENTION

This is the invention of a versatile system of a water container and attachments which make up a spa. The invention provides a way to construct a single spa which can be configured within the pool of water into any one of many seating arrangements and water/air jet placements. Although the household spa has been around for about twenty years and there has always been a demand by various customers for a wide variety of seating arrangements, only a limited variety has been offered. It has not been obvious to manufacturers how to provide a wide variety of designs without the expense of a special, major spa mold for each seating design. A way has not been proposed before to build spas which after completion can have their seating changed.

The current spas require a separate expensive mold for each seating configuration. The system of the present invention uses only a single large mold for the basic water container. That one large mold is outfitted with attachment points for the installation of furniture and numbers of ports for water/air jets. Particular ports may be selected for use while others might be plugged by a convenient bolt. Smaller molds are to be used for each individual piece of furniture of a particular shape which might be installed in the spa. Each piece is designed with anchor points for installation in the spa.

These anchor points match those of the basic water container. This provides a new versatility in the art enabling the practical production of a great variety of seating designs and greater versatility in the use of jets which impinge on the spa occupants.

Since the furniture surfaces are separated some distance from the vessel walls, there is room, unlike in conventional spas with the internal surface shaped to form seats, for jets of water or water/air to be directed from a distance at the person in a given seat rather than having the jet originate from the same wall as the seat itself. This allows all sorts of patterns and body impingements to be arranged for the jets.

The shape of the vessel under this invention can be almost anything, but a square shape without internal contours is preferred. However, steps or boxes protruding into the vessel water space can be molded wherever space behind the wall is desired for equipment.

The furniture design and placement allows space behind the furniture where tubing can be installed in a variety of ways to direct water or air/water at various body points for the occupant of a particular chair. The tubing would connect from a port on the wall to a port on a piece of furniture. It is the placement of the occupants body away from the wall upon furniture installed on the wall, rather than in a seat that is a contoured part of the wall itself, which allows the use of tubing to direct jets in various ways in the present invention.

Ever since spas were first made and sold, the concept of seating-in-the-wall has been carried out. Even though this results in a fixed seating arrangement for each large water-container mold, there has been no innovating of approach to get around that rigidity of form. The present invention does offer real flexibility in seating for a given large water-containing mold. Thus, the manufacturer need only buy and inventory one major mold. He also would manufacture a wide variety of pieces of spa furniture from which the customer would chose for the customer's own desires for the seating in his spa. Once the spa for a given customer is established, under the present invention, even then the seating arrangement could be changed.

BRIEF DESCRIPTION OF THE DRAWINGS

In FIGS. 5 and 6 only the outlines of the furniture are shown.

DESCRIPTION OF THE PREFERRED EMBODIMENT

The preferred embodiment described below illustrates each of the features of the versatile spa design. It is obvious that many other arrangements of jet placements and of furniture or furniture designs can be composed from the basic principle of versatility of layout. The empty spa has an arrangement of furniture and jet mounting places. All furniture and jets or jet hoses leading out from the wall are designed to fit the basic mounting places.

Figure 1:
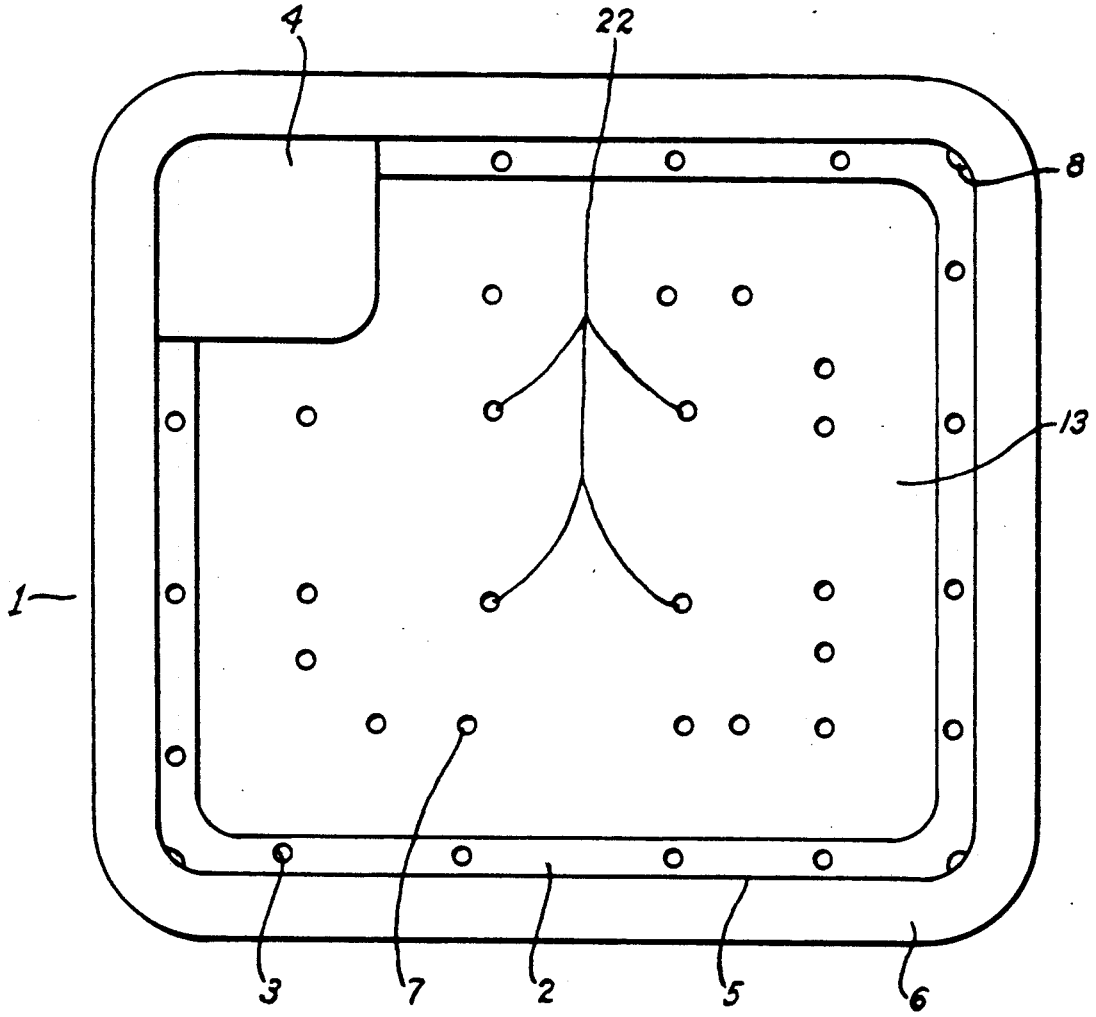
FIG. 1 is a plan view of a spa without furniture installed. Water outlets and controls are not shown.

In FIG. 1 the spa 1 is shown with an inner vertical wall 5, a step 2 part way up the wall, and a floor 13. One corner has a step intrusion 4 into the spa pool under which equipment such as pumps and heaters would be installed. Each spa is outfitted with threaded holes 3, 7, 20 (FIGS. 3 and 4) for mounting furniture. Holes 22 are used for jets of water and air. Holes in the corners for attaching the upper edge of bucket seats are represented by the filler bolt 8 which fills that mounting hole if a bucket seat is not installed. All furniture, regardless of configuration, has mounting points to match the holes 3, 7 and/or 20, the latter seen in FIGS. 3 and 4.

Figure 2:
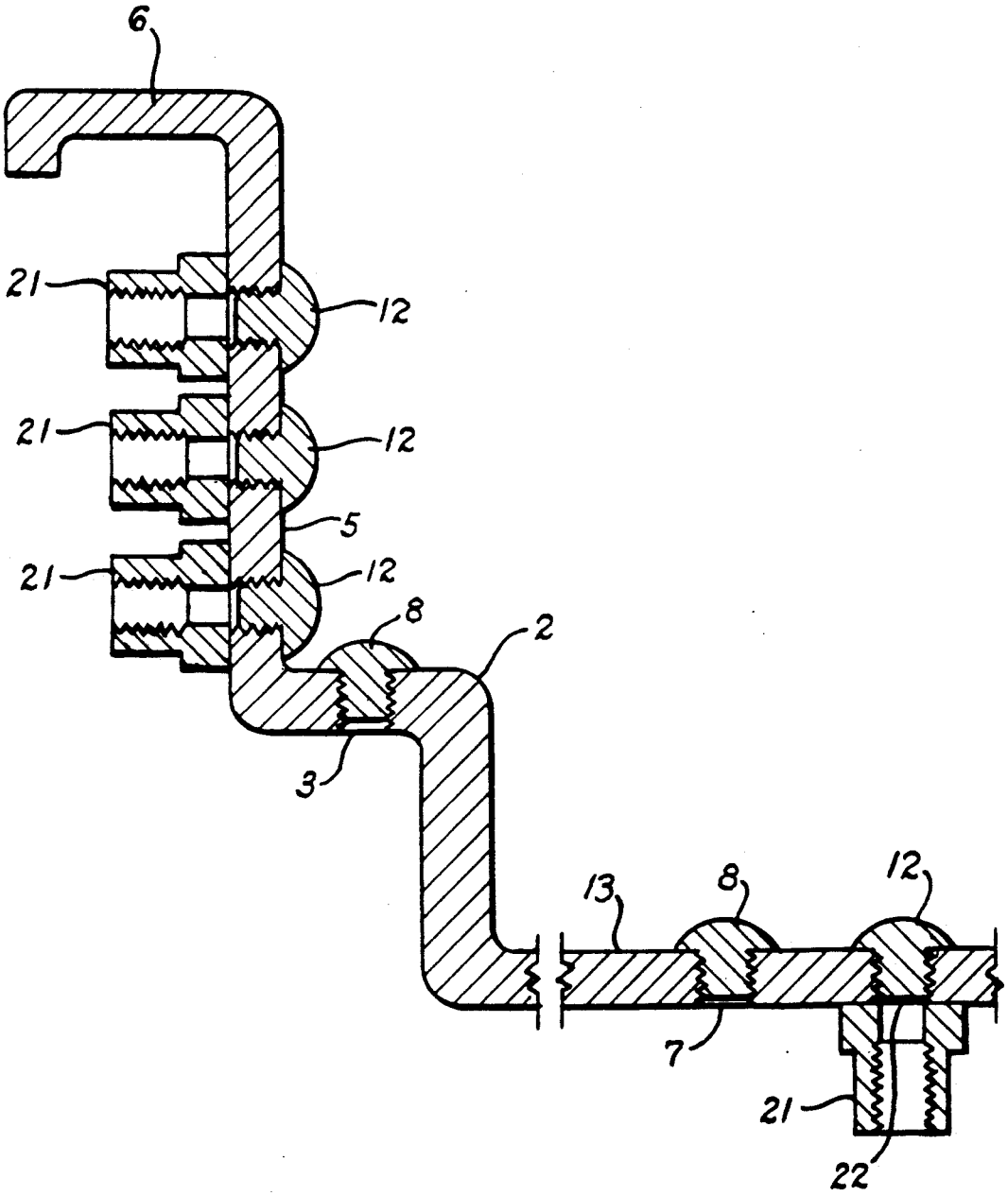
FIG. 2 is a cross sectional view of the side wall and a portion of the bottom of the spa.

In FIG. 2, each of the mounting holes has a round-head filler bolt 8 installed wherever the furniture layout does not require use of the mounting hole. The pipe mounting fixtures 21 are for pipes delivering air or air/-water mixtures to the pool of water in the spa. Unused openings in the spa walls and floor for furniture mountings and for jets are plugged by round head bolts 8 and 12 respectively. The sources of jets are connected to the spa walls and floor by fitting 21.

Figure 3:
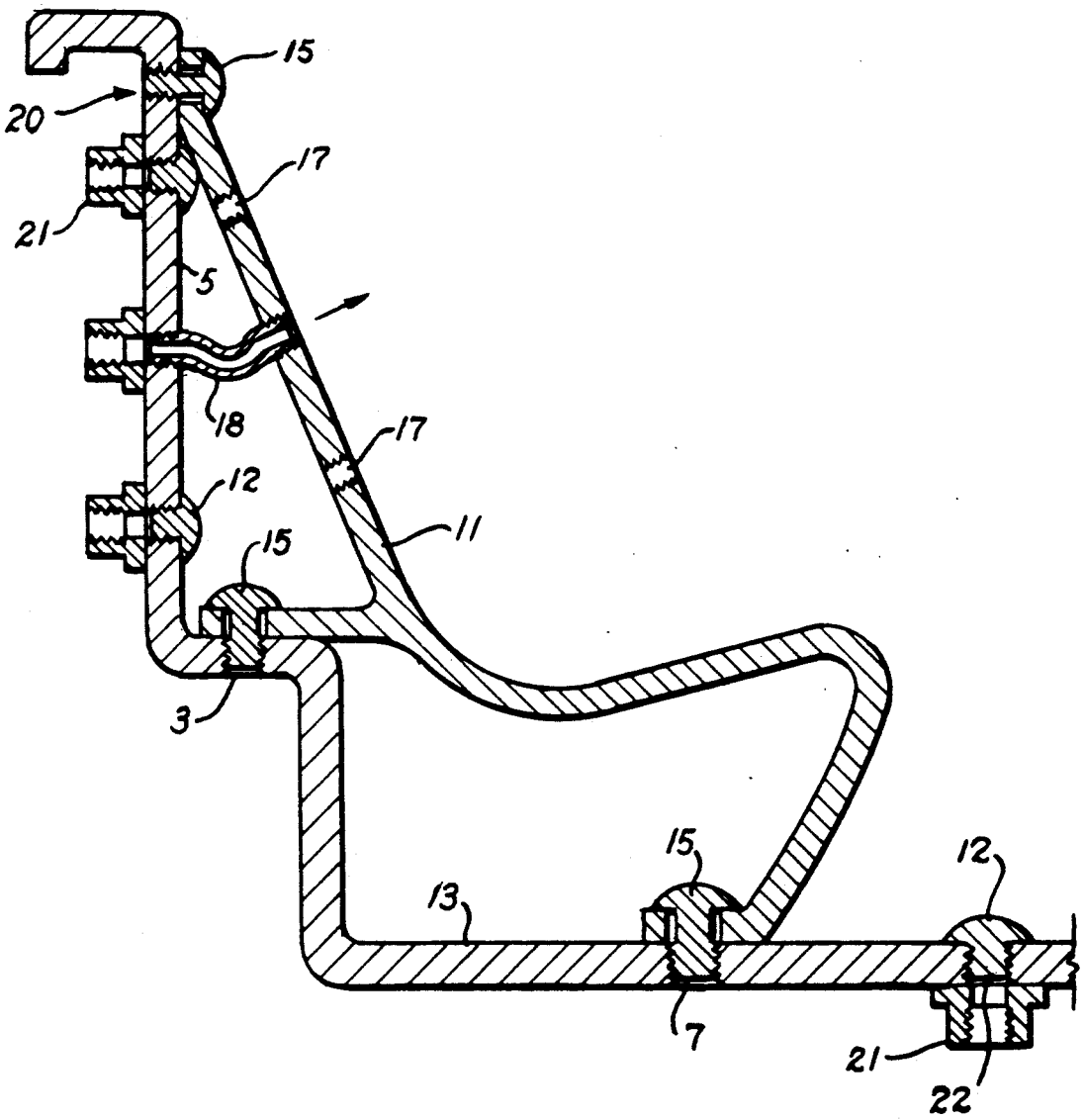
FIG. 3 is a cross sectional view of a bucket seat for a spa installed in the spa. The wall of the spa is also shown to illustrate the entry points for jets and the arrangement for one jet set to operate at the seat back.

In FIG. 3 a bucket type seat 11 is installed. The back of the seat is outfitted with three installation holes 17 for jets. In this case shown the middle point is arranged for a jet with the source of the jet coming from the walls and floor to the seat via the hose 18. The seat is mounted to the spa walls by bolts 15.

Figure 4:
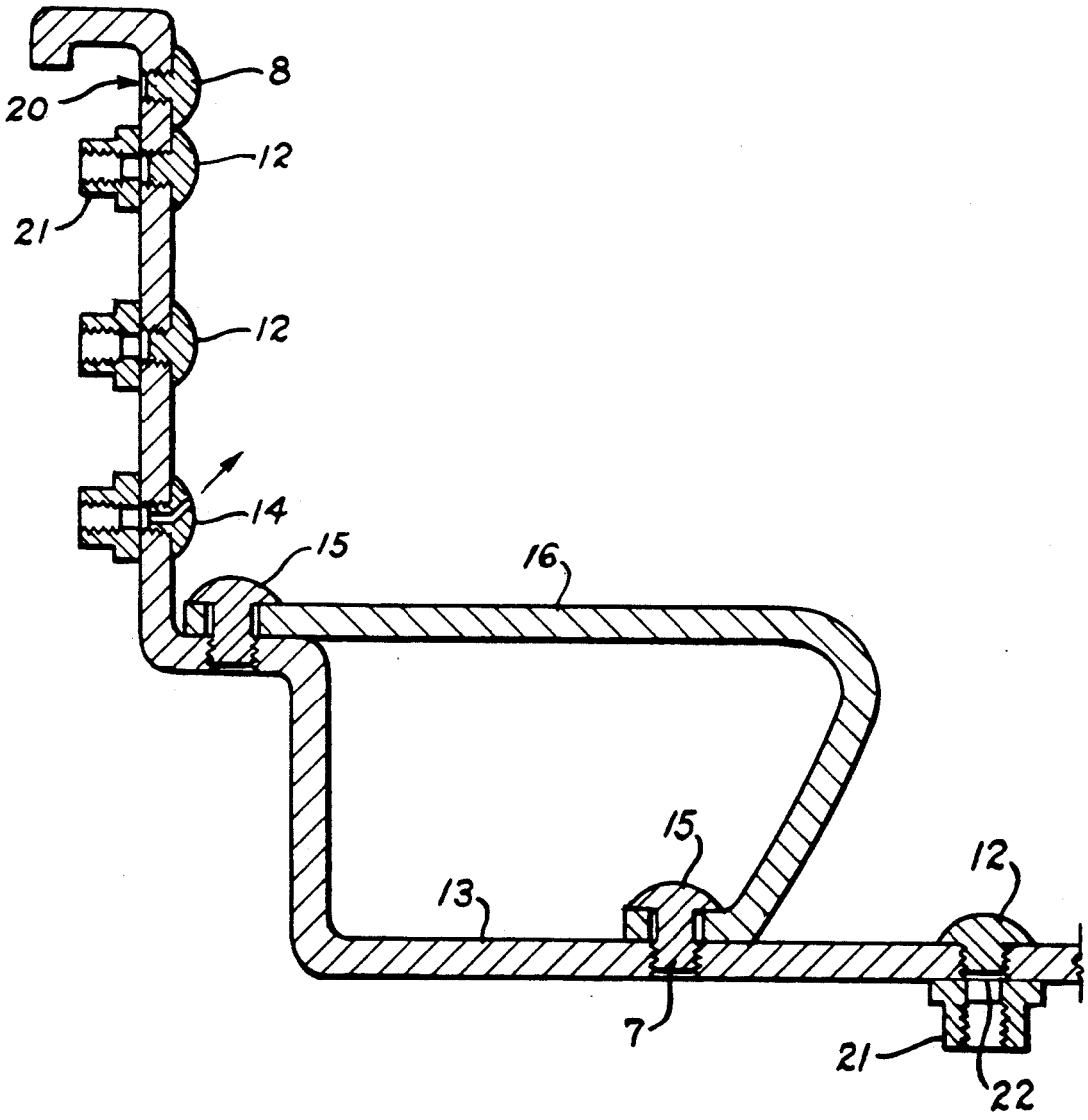
FIG. 4 is a cross section view of the spa wall with a bench seat installed and with one wall jet set to operate.

In FIG. 4 a bench type seat 16 is installed. A jet nozzle 14 is installed on the spa wall, in this case without a hose, to aim at the occupant's back.

Figure 5:
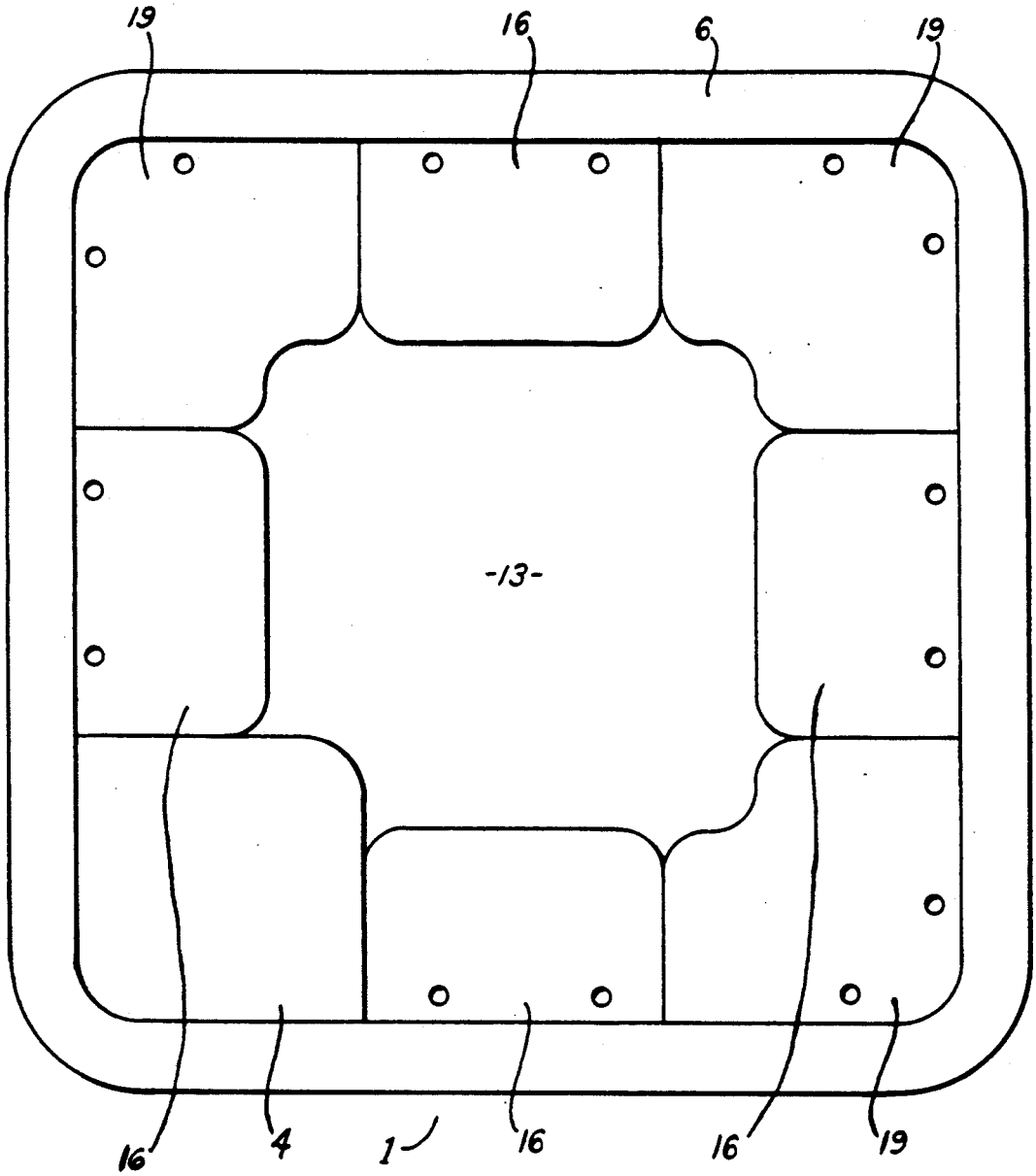
FIG. 5 is a plan view of the spa with bench seats installed.
Figure 6:
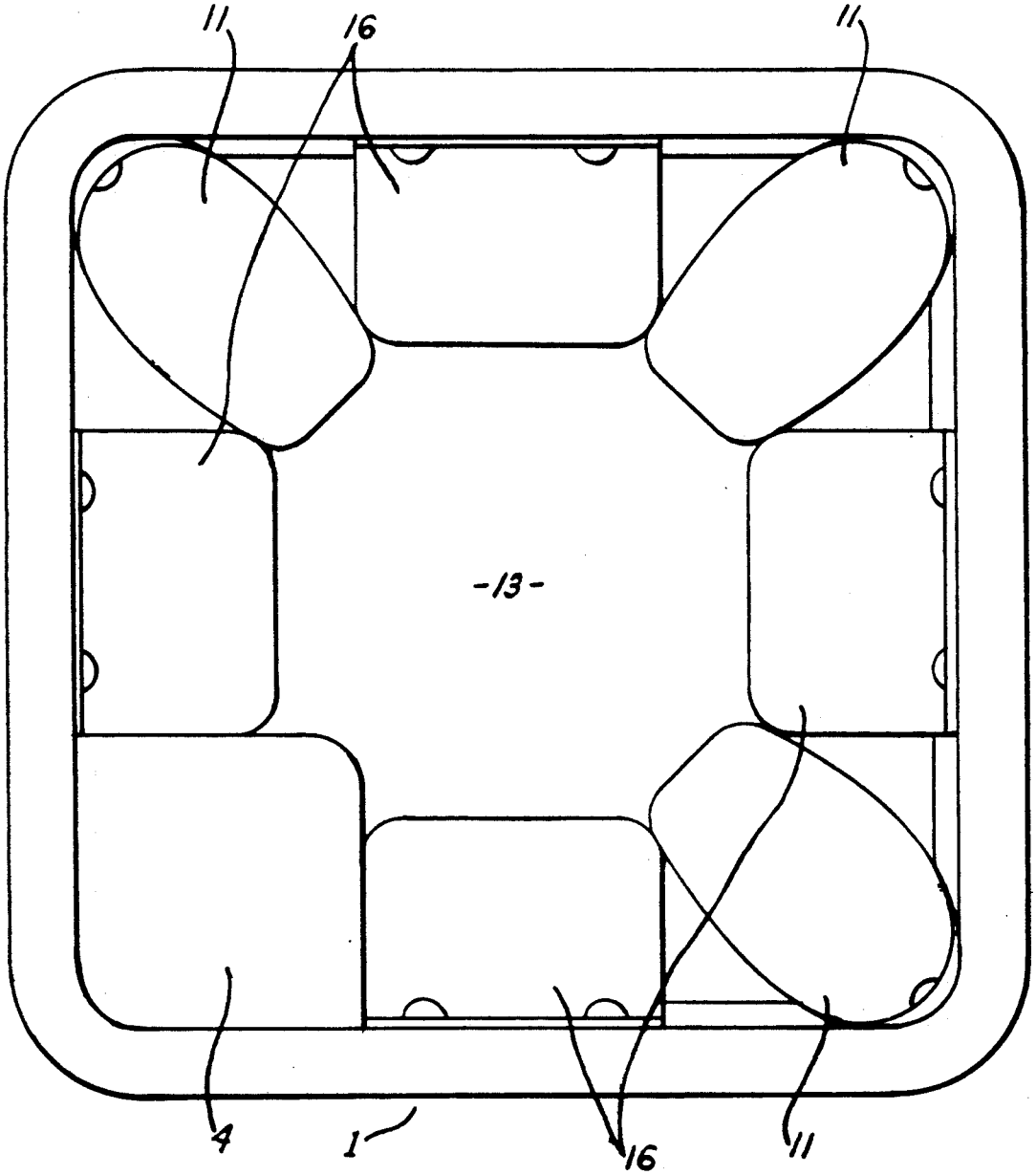
FIG. 6 is a plan view of the spa with bench and bucket seats installed.

The concept of interchangeable furniture, each piece arranged to mount by bolts at the fixed places on the spa wall, is demonstrated by FIGS. 5 and 6 which show just two examples of furniture arrangement. A third arrangement, no furniture, might be used to convert the spa into a children's pool. The spa vessel 1 in FIG. 5 has three corner bench seats 19 and four side bench seats 16 installed. The same spa in FIG. 6 is outfitted with three bucket seats 11 in the corners of the spa in place of the bench seats 19 of FIG. 5. While bucket seats and bench seats are illustrated in the figures, other types of furniture such as long benches, tables or stools might be adapted to attach to the spa walls at the mounting points.

I claim:

1. An improved spa including a vessel for water containment, seating and reclining arrangements, means for producing jets of air and air/water mixtures into the water, means for recirculating, heating and aerating the water within the vessel, the improvement comprising:

a water-containment vessel including side walls and a bottom surface, the vessel walls being outfitted with multiple outlets for ducting jets of water, air and water-air mixtures into the vessel, the vessel walls and bottom surface being outfitted at various points with means for mounting body-resting furniture to the walls, hoses attachable to the wall outlets and leading to the furniture, the means for mounting furniture being laid out at specific points on the vessel walls and bottom surface, the furniture being outfitted with means for attachment of the hoses at multiple location points, the hoses ducting jets of air and water-air mixtures from the wall outlets to selected location points on the furniture, the jets of air and water-air mixtures being ducted through openings in the furniture at the selected points and into the vessel, the furniture being in the form of seating having configurations such as bucket seats and benches, the furniture having mounting points which coordinate with the specific points on the vessel walls and bottom surface, whereby the vessel can be outfitted with a variety of furniture arrangements and jet placements.

2. The improved spa of claim 1 in which all of the seating may be removed to create a simple large pool of water.

3. The improved spa of claim 1 wherein the means for mounting furniture includes mounting holes in the vessel sides and bottom surface, and the holes and outlets located on the vessel walls and bottom are outfitted with plugs to fill the mounting holes and the outlets wherever they are not needed for a given configuration of furniture and water and air jets.

4. The improved spa of claim 1 manufactured by vacuum forming of sheet plastic to a female mold.

5. The improved spa of claim 1 manufactured by the method of rotational molding.

* * * * *